US007581518B2

(12) United States Patent
Gaiser

(10) Patent No.: US 7,581,518 B2
(45) **Date of Patent: *Sep. 1, 2009**

(54) COAXIAL OIL PUMP FOR BARREL ENGINES

(75) Inventor: Randall R. Gaiser, Dexter, MI (US)

(73) Assignee: Thomas Engine Company, LLC, Boulder, CO (US)

( * ) Notice: Subject to any disclaimer, the term of this patent is extended or adjusted under 35 U.S.C. 154(b) by 290 days.

This patent is subject to a terminal disclaimer.

(21) Appl. No.: 11/672,633

(22) Filed: Feb. 8, 2007

(65) Prior Publication Data

US 2007/0186880 A1 Aug. 16, 2007

Related U.S. Application Data

(60) Provisional application No. 60/773,234, filed on Feb. 14, 2006.

(51) Int. Cl.
*F02B 75/22* (2006.01)
*F02B 75/18* (2006.01)

(52) U.S. Cl. ..... 123/55.5; 440/88

(58) Field of Classification Search ..... 123/55.5, 123/55.7, 56.1–56.9, 241, 196 A, 196 AB, 123/197.1

See application file for complete search history.

(56) References Cited

U.S. PATENT DOCUMENTS

| | | | | |
|---|---|---|---|---|
| 2,243,817 | A | 5/1941 | Herrmann | |
| 3,016,110 | A * | 1/1962 | Herrmann | 184/6.17 |
| 6,192,853 | B1 | 2/2001 | Natsume et al. | |
| 6,575,125 | B1 * | 6/2003 | Ryan et al. | 123/56.1 |
| 6,694,931 | B2 * | 2/2004 | Palmer | 123/56.2 |
| 2007/0186881 | A1 * | 8/2007 | Gaiser | 123/56.1 |

* cited by examiner

*Primary Examiner*—Michael Cuff
*Assistant Examiner*—Hung Q Nguyen
(74) *Attorney, Agent, or Firm*—Gifford, Krass, Sprinkle, Anderson & Citkowski, P.C.

(57) ABSTRACT

A barrel internal combustion engine includes a plurality of pistons, a drive shaft, a cam plate and an oil pump. The plurality of pistons is slidably coupled to a plurality of cylinders for reciprocal movement along axes generally parallel with a central axis. The drive shaft is rotatable about the central axis. The cam plate is coupled to the drive shaft for rotation therewith. The cam plate is operatively coupled to the pistons to cause rotation of the drive shaft about the central axis in response to the reciprocal movement of the pistons. The oil pump has a rotatable input member coupled coaxially with the drive shaft for rotation therewith about the central axis for actuating the oil pump. The oil pump may be provided in the form of a geroter.

10 Claims, 4 Drawing Sheets

COAXIAL OIL PUMP FOR BARREL ENGINES

REFERENCE TO RELATED APPLICATION

This application claims priority to U.S. Provisional Patent Application Ser. No. 60/773,234, filed Feb. 14, 2006, the entire content of which is incorporated herein by reference.

FIELD OF THE INVENTION

The invention relates to barrel-type internal combustion engines. More particularly, the invention relates to oil pumps barrel-type internal combustion engines.

BACKGROUND OF THE INVENTION

Internal combustion engines are widely used for driving a variety of vehicles. Internal combustion engines come in a variety of configurations, which are typically aptly named for the particular orientation or arrangement of the reciprocating pistons and cylinders in the engines. One example of an internal combustion engine is a "V", type engine, in which the "V" refers to the arrangement of the cylinders in rows that are angled relative to each other to form a V shape. Another type of internal combustion engine that is most relevant to the invention is a barrel-type engine.

The barrel engine includes a plurality of cylinders and pistons arranged in the form of a "barrel" in which their axes are parallel to each other and typically arranged along a circle concentric with the drive shaft. Power is transmitted from the reciprocating pistons to a cam plate via a roller or bearing interface. The cam plate's nominal plane is perpendicular to the piston axes and attached to the drive shaft for movement therewith. The cam plate also has a generally sinusoidal shape, so that the axial reciprocal movement of the pistons causes rotational movement of the cam plate and drive shaft.

Barrel engines, like most conventional internal combustion engines, include oil pumps for pumping oil to high friction areas of the engine. The oil pumps are commonly driven by the drive shaft via gears or a pulley/belt arrangement, wherein an input shaft of the pump is arranged along an axis that is parallel to and spaced apart from the drive shaft.

SUMMARY OF THE INVENTION

According to one aspect of the invention, a barrel internal combustion engine includes a plurality of pistons, a drive shaft, a cam plate and an oil pump. The plurality of pistons is slidably coupled to a plurality of cylinders for reciprocal movement along axes generally parallel with a central axis. The drive shaft is rotatable about the central axis. The cam plate is coupled to the drive shaft for rotation therewith. The cam plate is operatively coupled to the pistons to cause rotation of the drive shaft about the central axis in response to the reciprocal movement of the pistons. The oil pump has a rotatable input member coupled coaxially with the drive shaft for rotation therewith about the central axis for actuating the oil pump.

According to another aspect of the invention, a barrel internal combustion includes a plurality of pistons slidably coupled to a plurality of cylinders for reciprocal movement along axes generally parallel with a central axis. A valve assembly controls the intake and exhaust of gases from the plurality of cylinders. A cam shaft is rotatable about the central axis to cause actuation of the valve assembly. The cam shaft has a first plurality of spline teeth. An oil pump is actuated by rotation of an input member. The input member has a second plurality of spline teeth. A drive shaft is rotatably driven about the central axis by the plurality of pistons. The drive shaft has a plurality of spline teeth formed on an end thereof. The spline teeth of the drive shaft engage both the first and second plurality of spline teeth for actuating the cam shaft and the oil pump during rotation of the drive shaft.

BRIEF DESCRIPTION OF THE DRAWINGS

Advantages of the present invention will be readily appreciated as the same becomes better understood by reference to the following detailed description when considered in connection with the accompanying drawings, wherein.

DETAILED DESCRIPTION OF THE INVENTION

The invention improves over conventional barrel engine designs by providing an oil pump having an input shaft that is coaxial with and driven by the drive shaft. This coaxial arrangement eliminates the need for gears or pulleys and belts, thereby simplifying the overall assembly of the barrel engine and reducing the costs associated therewith.

Figure 2:
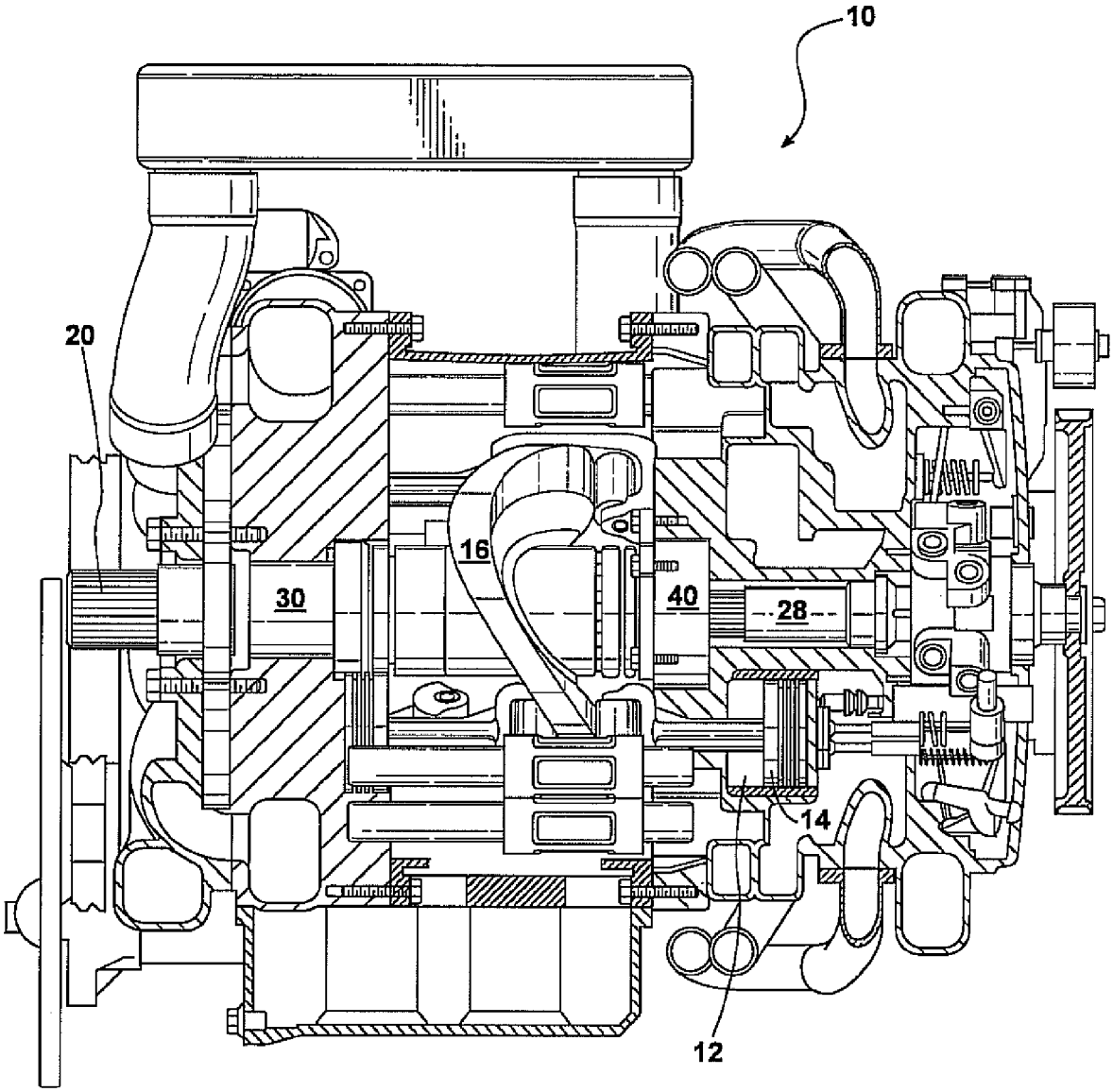
FIG. 2 is a cross sectional view of the barrel engine of FIG. 1.

Referring to the cross sectional view of FIG. 2, a barrel-type internal combustion engine according to the invention is generally indicated at 10. The engine 10 includes a plurality of cylinders 12 and pistons 14 arranged concentrically about a central drive shaft assembly 20. The pistons 14 are slidably engaged within the respective cylinders 12 for reciprocal axial movement therein. Power is transmitted from the reciprocating pistons 14 to a cam plate 16 via a roller or bearing interface. The cam plate 16 is coupled to the shaft assembly 20 for rotation therewith about a central rotational axis. The cam plate 16 has a generally sinusoidal shape, such that the reciprocal axial movement of the pistons 14 causes corresponding rotational movement of the cam plate 16 and shaft assembly 20.

Figure 3:
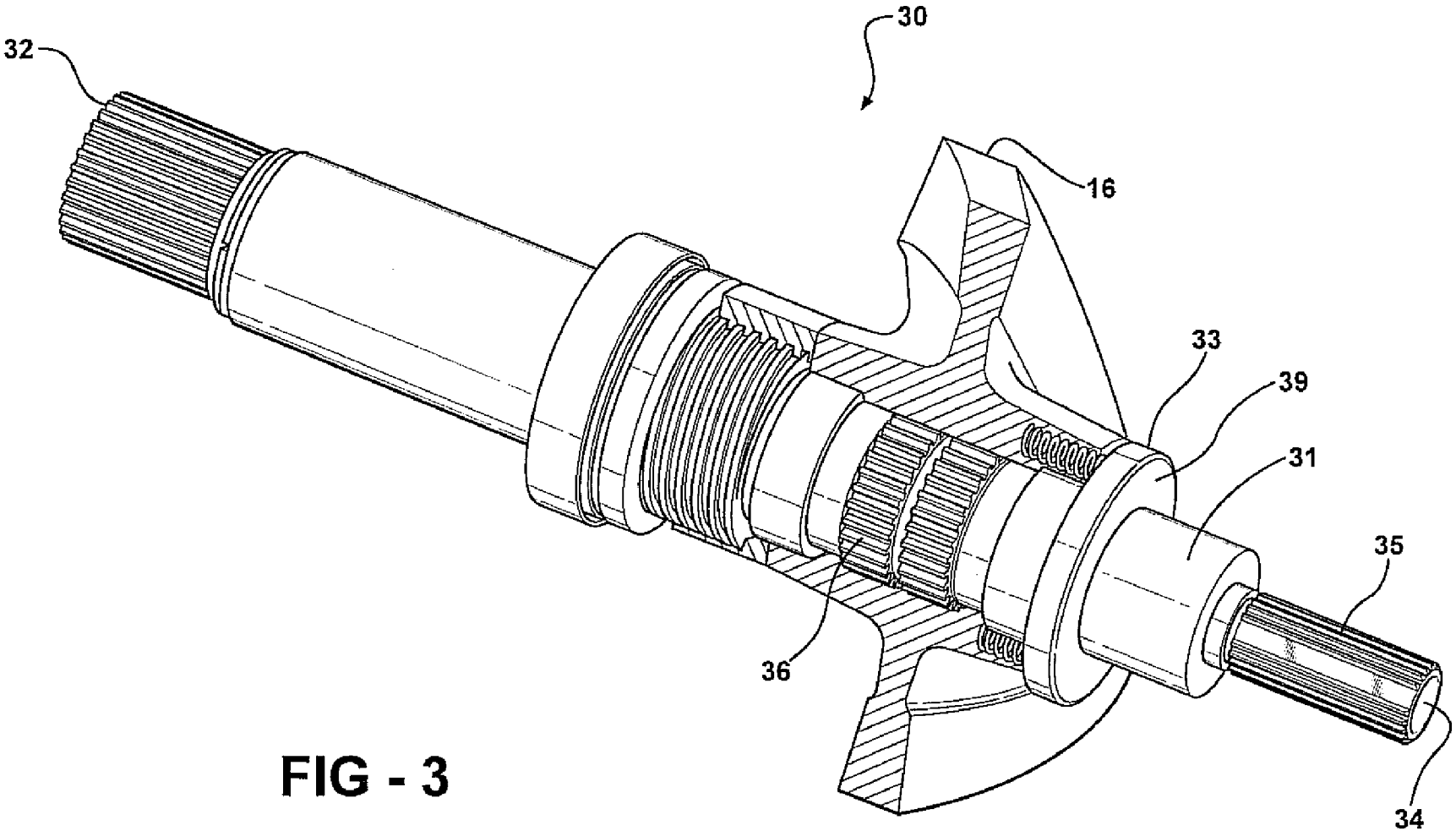
FIG. 3 is a front perspective view of a drive shaft in the barrel engine in FIG. 1.

The shaft assembly 20, in one embodiment of the invention. Includes a drive shaft 30 and a cam shaft 28. The drive 30 and cam 28 shafts are coupled in a splined arrangement, which couples the shafts 28, 30 in the rotational direction and allows assembly or disassembly in the axial direction. As shown in FIG. 3, the drive shaft 30 extends axially between opposite first 32 and second 34 ends. The first end 32 includes outwardly extending spline teeth for coupling the drive shaft 30 to a primary driven device, such as a transmission. A middle portion 36 of the drive shaft 30 includes outwardly extending spline teeth for engaging the cam plate 16. The second end 34 of the drive shaft 30 is defined by a reduced diameter portion having outwardly extending spline teeth 35. A main bearing or bearing surface 31 is provided close to the second end 34. A thrust bearing or bearing surface is shown at 39. As will be clear to those of skill in the art, the splined portions may be formed differently than shown, and the drive shaft configuration may be different than shown.

Figure 1:
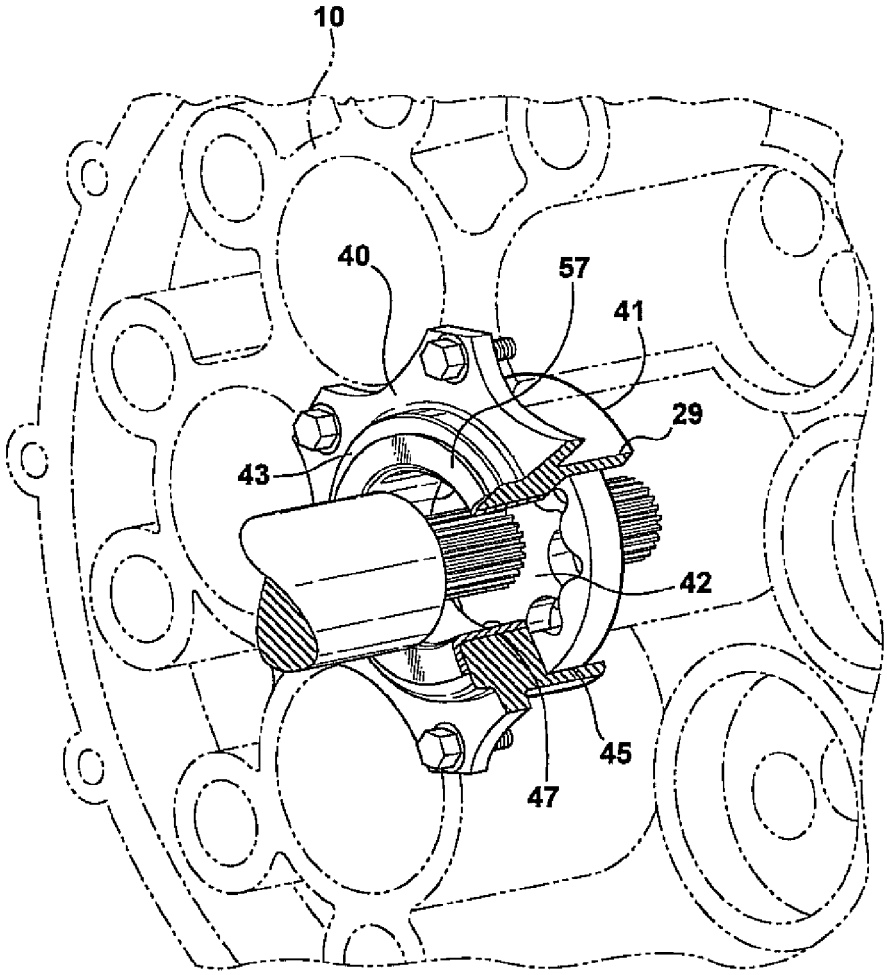
FIG. 1 is an enlarged front perspective view of a portion of the barrel engine according to one aspect of the invention, with the oil pump shown mounted coaxially with the drive shaft of the barrel engine.
Figure 4:
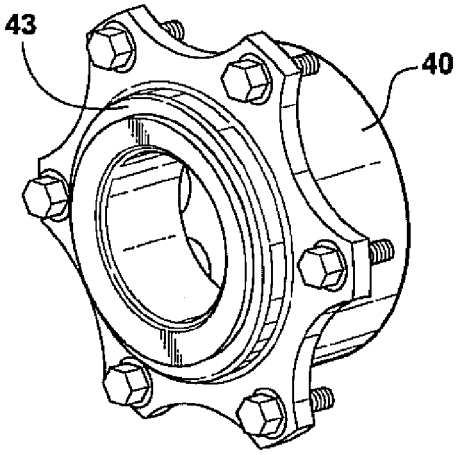
FIGS. 4 and 5 are front and rear perspective views of an oil pump for the barrel engine.
Figure 5:
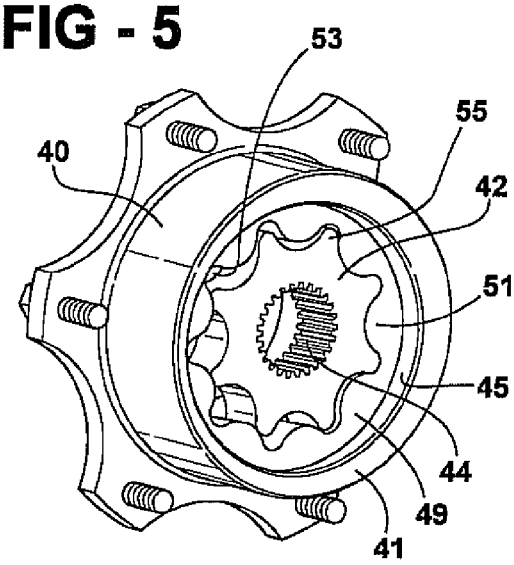

In FIGS. 1 and 2, an oil pump 40 for delivering oil throughout the engine 10 is shown coupled to the second end 34 of the drive shaft 30. The oil pump 40 is illustratively shown as a geroter-type pump. It should, however, be readily appreciated by persons having ordinary skill in the art that other types of pumps operable by rotation of an input member may be used. Referring to FIGS. 1, 4 and 5, the oil pump 40 includes a housing 29 that extends between opposite first 41 and second 43 ends. The housing 29 includes a cylindrically shaped first inner surface 45 adjacent the first end 41. The housing 29 includes a cylindrically shaped second inner surface 47 adjacent the second end 43. In the illustrated embodiment, the first inner surface 45 has a larger diameter than the second inner surface 47. The first 45 and second 47 inner surfaces are generally coaxially aligned and define a continuous center bore that extends through the housing 29.

The oil pump 40 includes a cylindrically shaped external rotor 49. The external rotor 49 has a smaller outer diameter than the first inner surface 45. The external rotor 49 rolls along the first inner surface 45 in an eccentric manner relative to the center axis of the center bore. The external rotor 49 includes a plurality of inner teeth 51 that extend radially inwardly toward a center aperture 53. An internal rotor or input member 42 is disposed in the center aperture 53. The input member 42 includes a plurality of outer teeth 55 for engaging the inner teeth 51 of the external rotor 49. The input member 42 includes a center bore 44 for receiving the second end 34 of the drive shaft 30 coaxially therethrough. The walls defining the center bore 44 of the input member 42 include a plurality of spline teeth complementary with the spline teeth of the second end 34 of the drive shaft 30. The input member 42 rotates with the drive shaft 30 about the rotational axis. The internal rotor 42 has one less tooth than the external rotor 49, so that the number of rotations of the external rotor 49 is reduced relative to the internal rotor 42. The rotation of the internal rotor 42 causes eccentric or wobbling rotation of the external rotor 49 along the first inner surface 45. Oil is compressed between the external rotor 49 and the first inner surface 45 and directed through an outlet (not shown) in the housing 29 for distribution to various parts of the engine.

A main bearing 57 is supported by the oil pump 40 and is disposed in the second inner surface 47 of the housing 29. The main bearing 57 includes a bearing surface for mating with the bearing surface 31 on the drive shaft and a thrust surface for mating with the thrust bearing surface 39.

Figure 6:
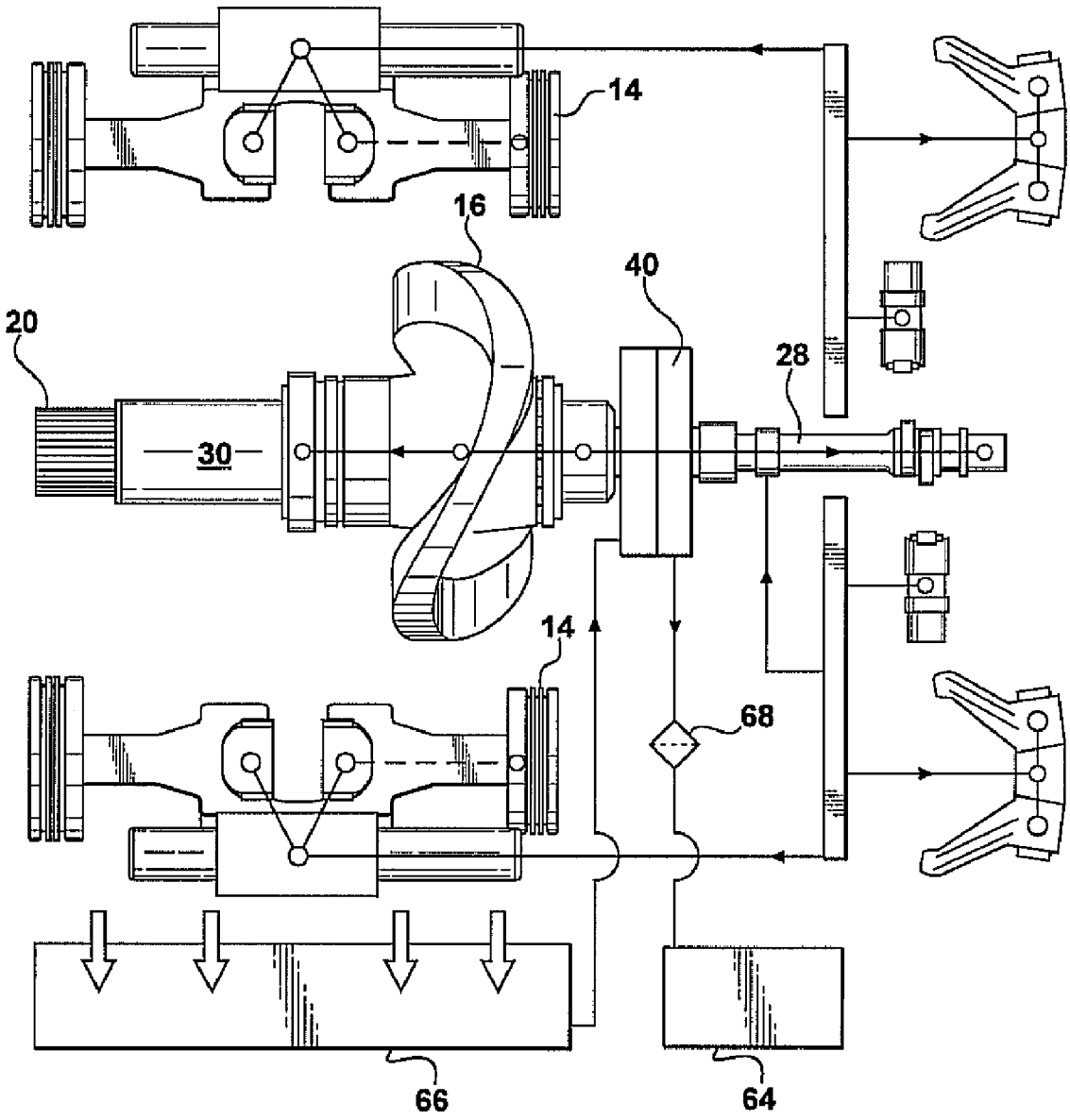
FIG. 6 is a schematic view of the oil delivery system for the barrel engine.

As shown in FIG. 6, oil feed lines extend between the oil pump 40 and various high friction areas of the engine, such as the bearings. At least one of the feed lines may be directed through an oil cooler 64, where heat generated by the engine 10 is exchanged with engine coolant passing through the oil cooler 64. At least one supply line extends between an oil pan 66 and the oil pump 40. An oil filter 68 is coupled to the feed line between the oil pump 40 and the oil cooler 64 for filtering particulate from the oil flow passing therethrough.

Still referring to FIG. 6, the reciprocating movement of the pistons 14 causes rotational movement of the cam plate 16 and, in turn, the shaft assembly 20. The input member 42 rotates with the drive shaft 30 of the shaft assembly 20. The oil pump 40 is driven by the rotation of the input member 42 with the drive shaft 30. Oil is supplied from the pan 66 to the oil pump 40 via the supply line. Oil is delivered by the oil pump 40 via the feed lines to the high friction areas of the engine 10. Oil is gravity fed back to the pan 66, where it is recirculated during continued operation of the engine 10. As will clear to those of skill in the art, the positioning of the oil pump in a coaxial relationship with the drive shaft, and the location of the oil pump, is advantageous and makes use of space that may otherwise be wasted. It also provides for the oil pump to be directly driven, thereby eliminating intermediate parts.

The invention has been described in an illustrative manner. It is, therefore, to be understood that the terminology used is intended to be in the nature of words of description rather than of limitation. Many modifications and variations of the invention are possible in light of the above teachings. Thus, within the scope of the appended claims, the invention may be practiced other than as specifically described.

I claim:

1. A barrel internal combustion engine comprising:

a plurality of pistons slidably coupled to a plurality of cylinders for reciprocal movement along axes generally parallel with a central axis;

a drive shaft rotatable about the central axis;

a cam plate coupled to the drive shaft for rotation therewith, the cam plate being operatively coupled to the pistons to cause rotation of the drive shaft about the central axis in response to the reciprocal movement of the pistons; and an oil pump having a rotatable input member coupled coaxially with the drive shaft for rotation therewith about the central axis for actuating the oil pump, the oil pump having a housing including a bearing support, a bearing being disposed in the bearing support, the bearing supporting an end is a pump.

2. A barrel internal combustion engine as set forth in claim 1, wherein the oil pump is a geroter pump.

3. A barrel internal combustion engine as set forth in claim 1, including a cam shaft coaxially assembled to the drive shaft.

4. A barrel internal combustion engine as set forth in claim 3, wherein the drive shaft and cam shaft have spline teeth in mating engagement with each other for transferring torque therebetween.

5. A barrel internal combustion engine as set forth in claim 3, wherein the drive shaft includes an end having a plurality of radially outwardly extending spline teeth for engaging corresponding spline teeth on the cam shaft.

6. A barrel internal combustion engine as set forth in claim 5, wherein the input member includes spline teeth engaged with the spline teeth on the drive shaft such that the oil pump is actuated by rotation of the drive shaft.

7. A barrel internal combustion engine as set forth in claim 1, including a first oil feed line driving oil from the pump to an oil cooler.

8. A barrel internal combustion engine as set forth in claim 1, including a oil pan from which oil is fed via a second oil feedline to the oil pump.

9. A barrel internal combustion engine comprising:

a plurality of pistons slidably coupled to a plurality of cylinders for reciprocal movement along axes generally parallel with a central axis;

a valve assembly controlling the intake and exhaust of gases from the plurality of cylinders;

a cam shaft rotatable about the central axis to cause actuation of the valve assembly, the cam shaft having a first plurality of spline teeth;

an oil pump actuated by rotation of an input member, the input member having a second plurality of spline teeth;

a dive shaft rotatably driven about the central axis by the plurality of pistons, the drive shaft having a plurality of spline teeth formed on an end thereof, the spline teeth of the drive shaft engaging both the first and second plurality of spline teeth for actuating the cam shaft and the oil pump during rotation of the drive shaft.

10. A barrel internal combustion engine as set forth in claim 9, wherein the oil pump is a geroter pump.

* * * * *